US007431180B2

(12) United States Patent
Bonerb

(10) Patent No.: US 7,431,180 B2
(45) Date of Patent: Oct. 7, 2008

(54) DEVICE AND METHOD FOR DISCHARGING DRY MATERIALS FROM STORAGE VESSELS

(75) Inventor: Timothy C. Bonerb, Kansas City, MO (US)

(73) Assignee: Shick Tube-Veyor Corp., Kansas City, MO (US)

( * ) Notice: Subject to any disclaimer, the term of this patent is extended or adjusted under 35 U.S.C. 154(b) by 187 days.

(21) Appl. No.: 10/711,362

(22) Filed: Sep. 14, 2004

(65) Prior Publication Data

US 2006/0054639 A1 Mar. 16, 2006

(51) Int. Cl.
*B67D 5/06* (2006.01)
*B65G 69/06* (2006.01)

(52) U.S. Cl. ..... 222/185.1; 222/195

(58) Field of Classification Search ..... 222/185.1, 222/195

See application file for complete search history.

(56) References Cited

U.S. PATENT DOCUMENTS

| | | | | | |
|---|---|---|---|---|---|
| 3,708,209 | A | * | 1/1973 | Dugge | 406/91 |
| 4,413,758 | A | * | 11/1983 | Walters | 222/195 |
| 4,846,377 | A | * | 7/1989 | Fix et al. | 222/195 |
| 5,096,096 | A | * | 3/1992 | Calaunan | 222/195 |
| 5,603,359 | A | * | 2/1997 | Geiser | 141/1 |

* cited by examiner

*Primary Examiner*—Joseph A. Kaufman
(74) *Attorney, Agent, or Firm*—Phillip E. Decker; Mesmer & Deleault, PLLC

(57) ABSTRACT

An apparatus for discharging dry bulk material by aeration having a substantially annular flexible aeration liner supported by a substantially cone-shaped perforated hopper, which is affixed to an air disc assembly, whereby air introduced into the air disc assembly is distributed evenly through the perforated hopper that supports the aeration liner that tends to fluidize dry bulk material, thereby allowing the material to discharge.

12 Claims, 7 Drawing Sheets

DEVICE AND METHOD FOR DISCHARGING DRY MATERIALS FROM STORAGE VESSELS

BACKGROUND

1. Field of Invention

This invention relates to improvements for discharging dry, powder-like materials from storage silos.

2. Description of Related Art

As many bakeries and other processors of powder materials (such as flour, starch, talc and the like that can be fluidized for more efficient discharge) improve their operations, the need for an aeration discharge device that is virtually maintenance free, allows a quick change aeration liner method and that can empty the contents of a silo in excess of 99% is required.

One of the more vexing problems in providing a heavy-duty discharge aeration liner device is that the surface under the liner must allow the free flow a air through itself and still be able to maintain loads of as much as 1,200 per square foot. In addition, the aeration liner must be fabricated so that it does not leak and be fabricated in a cone-like shape in excess of 15 degrees. During the past thirty to forty years, as more and more industries require a discharge method, ensuring first-in, first-out discharge, complete clean out and a quick and easy method for replacing a used aeration liner, the need for this invention has grown.

SUMMARY

It is the object of the invention to provide a simple and heavy-duty method of fabrication of the device.

Another object of the invention is to reduce and eliminate infestation of materials, such as flour and other grain products, as they are stored in the bulk system.

Another object of the invention is to provide a quick, safe and easy method of replacing the aeration liner.

Yet another object of the invention is to provide a low-cost structural design and less expensive structural components of the discharge device.

Another object of the invention is to provide a sanitary, smooth and virtually seamless interior wall surface to reduce the chance of contamination, infestation and leaking.

It is another object of the invention to provide a simple and reliable device for distributing the air to each of the zones of the fluidized bed.

Another object of the invention is to provide it in a kit form for easy shipping and handling.

It is another object of the invention to provide the invention in a form and design that is quick and easy to erect and assemble.

Yet another object of the invention is to allow the user a quick and easy method for removing and replacing the fluidized bed.

Another object of the invention is to eliminate the use of fasteners for holding the aeration liner in place.

DETAILED DESCRIPTION OF DRAWINGS

Figure 1:
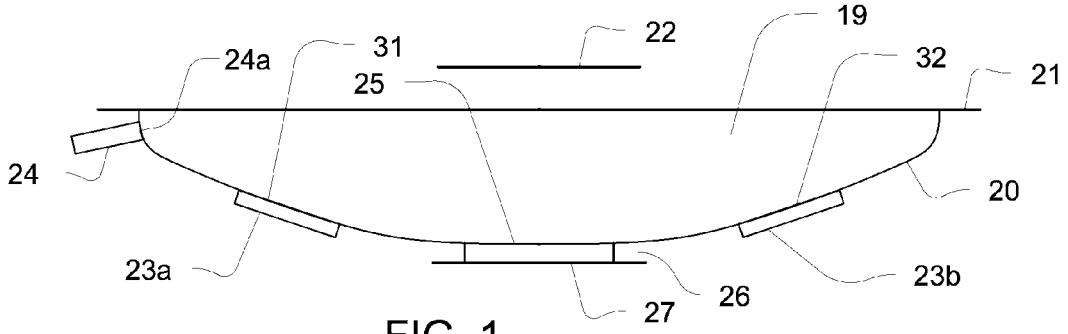
FIG. 1 is a side view of the dished head component of the air disc.

FIG. 1 is a side view of air disc 19. Fabrication of disc 19 begins by cutting access port openings 31 and 32, air stub opening 24*a* and outlet opening 25.

Bolt holes (not shown) are made in flange ring 21 and then welded to dished head 20. Air stub nozzle 24 is welded around air stub opening 24*a* to allow an air passageway inside dished head 20. Access port flanges 23*a* and 23*b* are welded to access port openings 31 and 32 respectively. Outlet collar 26 with outlet flange 27 is welded around outlet opening 25. Outlet flange ring 22 will be used to secure aeration liner (not shown) around outlet opening 25. Air disc 19 can be made with multiple openings 25, each opening having its own outlet collar 26 and outlet flange 27.

Figure 2:
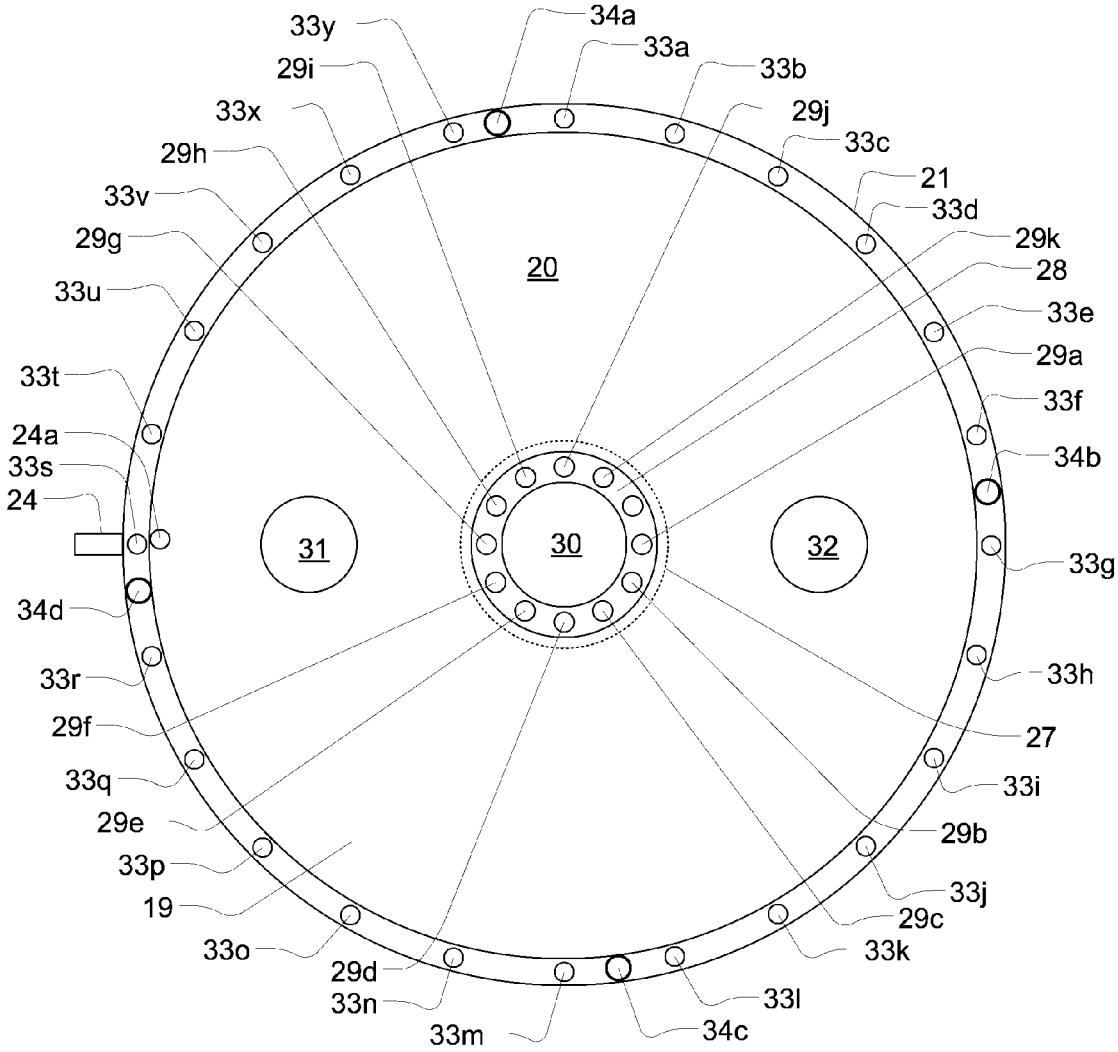
FIG. 2 is a top view of the dished head component of the air disc.

FIG. 2 is a top view of air disc 19. Flange bolts holes 33*a*–33*x* are shown spaced equally apart on flange ring 21. Threaded boltholes 34*a*–34*d* are also shown spaced equally apart around the perimeter area of flange ring 21. Outlet boltholes 29*a*–29*k* are made to register in holes (not shown) of outlet flange ring 22. Outlet flange 27 is shown under dished head 21 around outlet flange opening 30.

Figure 3:
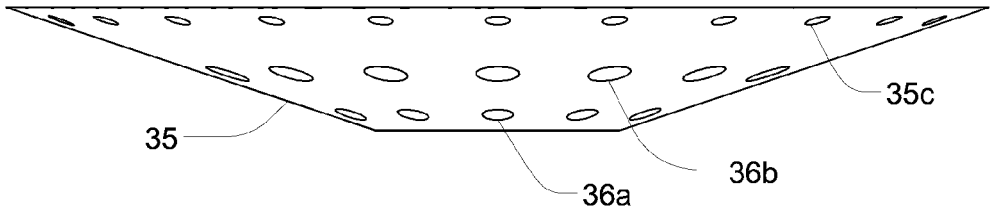
FIG. 3 is a side view of the perforated hopper component of the air disc.

FIG. 3 is a side view of perforated hopper 35. Hole(s) 36*c* are made around perforated hopper at a large radius, hole(s) 36*b* are made around perforated hopper at a medium sizes radius and holes(s) 36*a* make up the airways in perforated hopper 35. The hopper 35 is preferably frustro-conical shaped.

Figure 4:
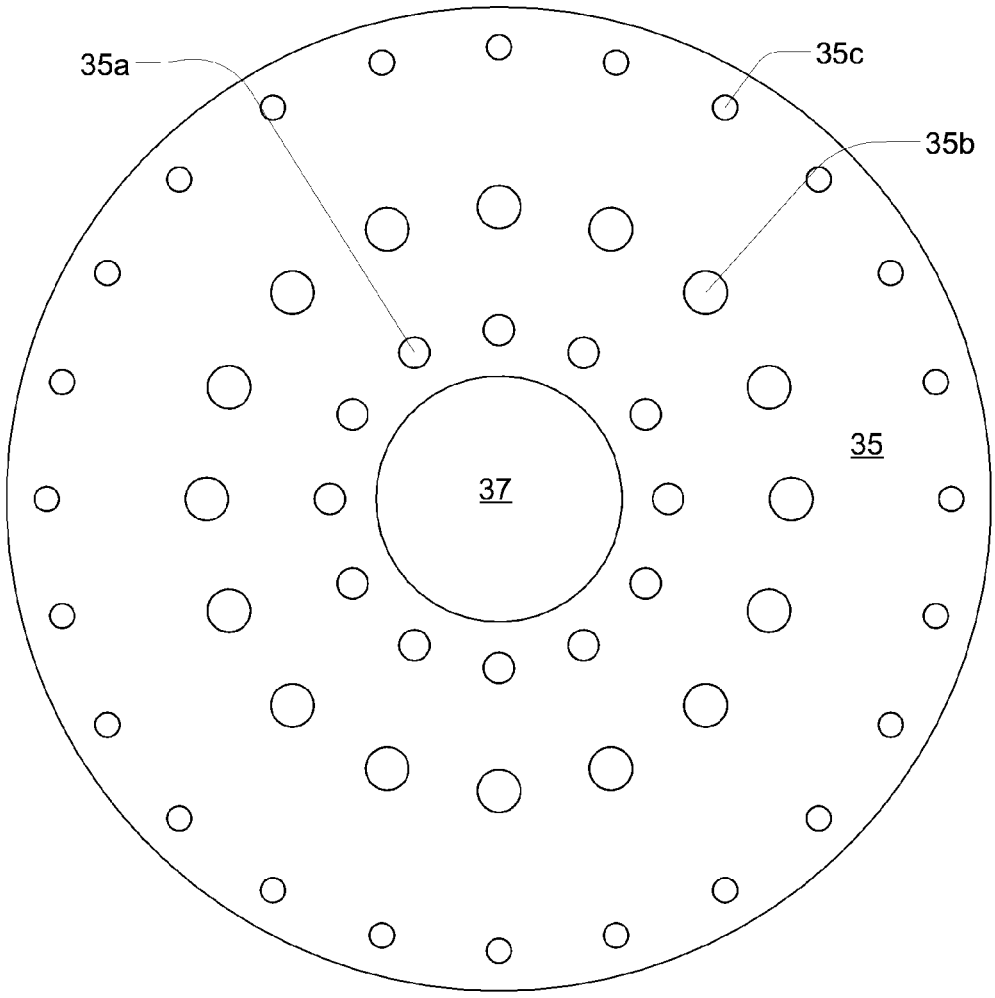
FIG. 4 is a top view of the perforated hopper component of the air disc.

FIG. 4 is a top view of perforated hopper 35 with radius holes 36*a*, 36*b* and 36*c*. Perforated hopper opening 37 is in the center of perforated hopper 35. Perforated hopper 35 may be fabricated with multiple hopper opening(s) 37 depending on the customer's application. Perforated hopper 35 is typically made with a slope of approximately 20 degrees.

Figure 5:
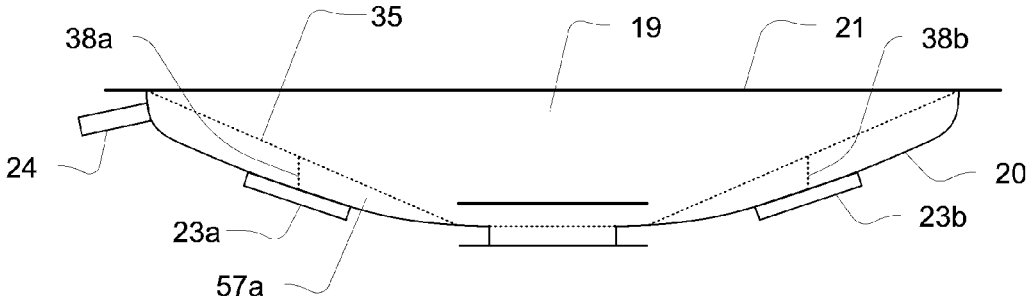
FIG. 5 is side view of the air disc, showing the perforated hopper installed.

FIG. 5 is a side view of air disc 19 with perforated hopper 35 welded inside. Air compartment 57*a* is created between dished 20 and perforated hopper 35 so air may diffuse equally under the entire surface area of perforated hopper 35.

Figure 6:
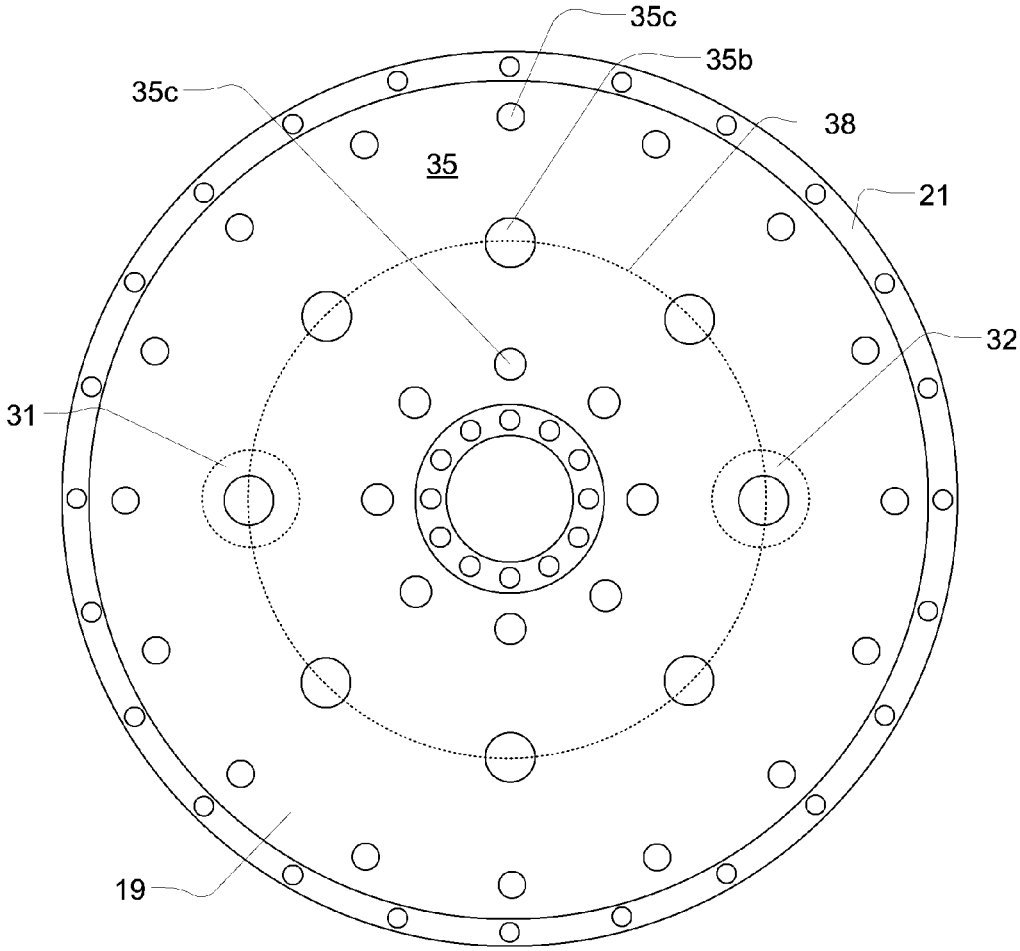
FIG. 6 is a top view of the air disc with the perforated hopper installed.

FIG. 6 is a top view of air disc 19 with perforated hopper 35 welded inside. Hopper support ring 38 is welded to the under side of perforated hopper 35 to provide extra support when the storage vessel (not shown) is filled. Rows of holes 35*a*, 35*b* and 35*c* should account for approximately 20% to 50% of the area of perforated hopper 35. Any holes 35*a*, 35*b* and 35*c* more and perforated hopper 35 may become weakened and any less and the aeration method may become uneven and cause flow problems. Perforated hopper 35 may be made of multiple sections and then welded into dished head 20. Air disc 19 can also be made with multiple perorated hopper sections 35 (not shown), each one independent of the other for multiple discharge requirements.

Figure 7:
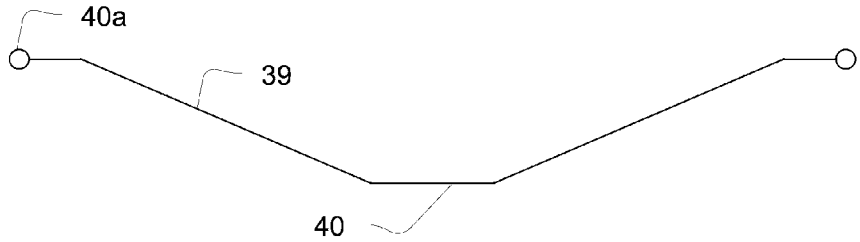
FIG. 7 is a side view of the aeration liner.

FIG. 7 is a side view of aeration liner 39 with outlet opening 41 and roped edge 40*a* assembly around its perimeter.

Figure 8:
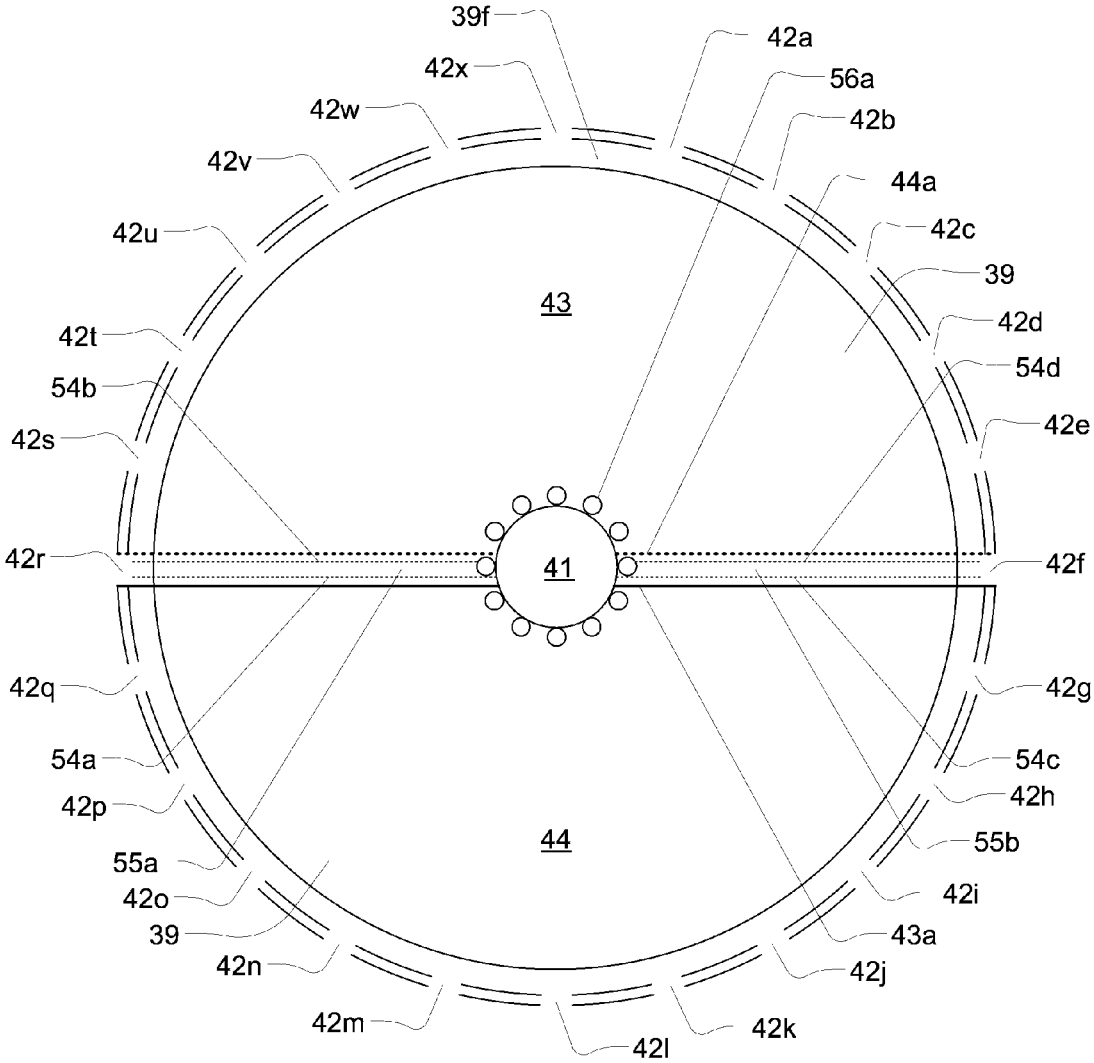
FIG. 8 is a detailed, top view of the aeration liner.

FIG. 8 is a top view of aeration liner 39. Top panel 43 and bottom panel 44 are cut so that when joined together they form a hopper-like cone with the same slope angle as the perforated hopper (not shown). Top panel 43 and bottom panel 44 may be cut from the same pattern and are generally made from a 4 ply, polyester woven fabric. All cut edges of aeration liner are heat-cut to melt the polyester so that it will not fray. Stitched seams 54*a*, 54*b*, 54*c* and 54*d* are used to joint and fasten top panel 43 to bottom panel 44. Scallop cut openings are made in perimeter flange 39*f* area so that bolts may remain between the silo and air disc. Perimeter holes 56*a* are cut in the center of aeration liner 39 around outlet opening 41. A sealant may be applied to area 55*a* and 55*b* between top panel 43 and bottom panel 44 to help prevent leaking. Sealant and/or gasketing material may be pre-applied to top and bottom areas of perimeter flange area 39*f*. Extra layers of flexible material such as fabric or rubber, as well as rigid materials such as steel, may be used in the perimeter flange 39*f* area to make up the difference and even out between a single layer of fabric and the double layer of fabric between seams 44*a* and 43*a*. Aireation liner 39 can also be made with multiple openings having separate inflation compartments when used for applications having multiple discharge requirements.

Figure 9:
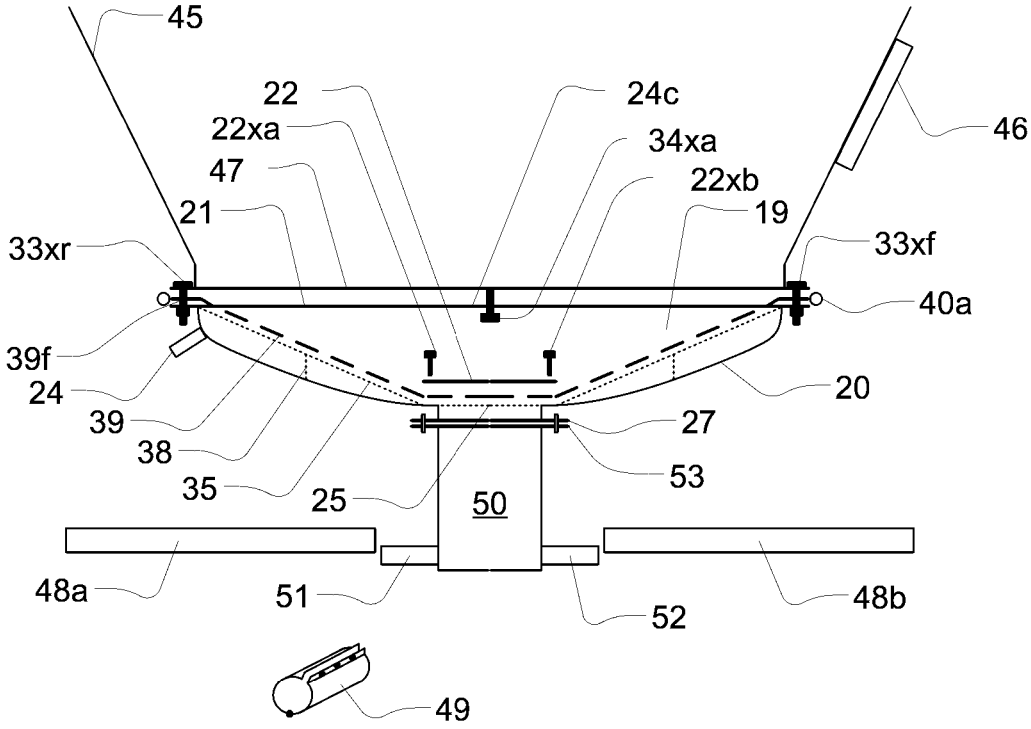
FIG. 9 is a side view of the air disc attached to but disengaged from the silo for the liner changing operation.

FIG. 9 is a detailed side view of air disc 19 attached to silo hopper 45. To change and/or install a new aeration liner 39, perimeter flange bolts 33*xa*–33*xx* (33*xr* and 33*xf* shown) are loosened. Bolts 34*xa*–34*xd* are placed in threaded flange holes 34*a*–34*d* respectively (34*xa* is shown). Bolts 34*xa* to 34*xd* are used to help spread silo flange 47 and flange ring 21, especially is a sealant was used when installing the previous aeration liner. Scallop cut opening 42*a*–42*x* enable aeration liner 39 to be removed without having to remove air disc 19 from silo hopper 45. Couplings 49 (and 49*a*, not shown) may be unfastened and removed from joints between conveyor tube 48*a* and entry tube 51 of rotary valve assembly 50 and between exit tube 52 and conveyor tube 48*b*. Roped edge 40*a* may be used around perimeter flange 39*f* area for extra support and grip to hold aeration liner in place. Perforated hopper 35 is used to support aeration liner 39. Outlet flange 27 and stack-up flange 53 may be slotted to provide more rotation and position points when aligning conveyor tubes 48*a* and 48*b* with entry tube 51 and exit tube 52. Outlet flange ring bolts 22*xa*–22*xk* (22*xa* and 22*xb* shown) are used to secure outlet flange ring 22 around outlet opening 25 of dished head 20.

Figure 10:
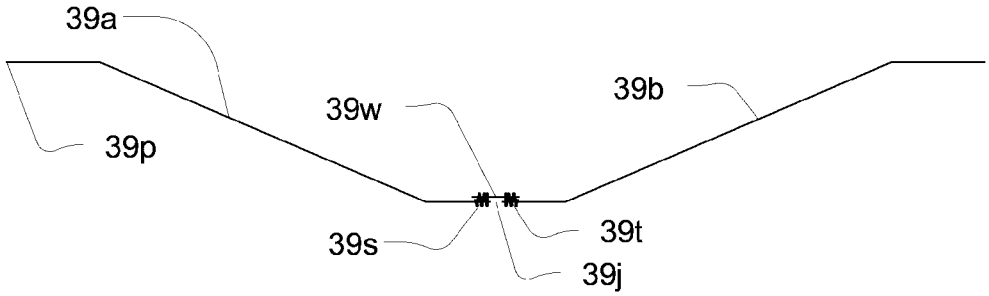
FIG. 10 is a side view of the aeration liner sections jointed together by a webbing strip.

FIG. 10 is a side view of left half of aeration liner 39*a* and right half of aeration liner 39*b* butted together at joint 39*j*. Webbing strip 39*w*, which can be made of polyester or nylon webbing that is approximately 3 inches wide can be sewn to left half of aeration liner 39*a* with stitching 39*s* and right half of aeration liner 39*b* with stitching 39*t*. By using webbing strip 39*w* that is relatively thin, approximately 1/32" to 1/8" thick, to join left half of aeration liner 39*a* to right half of aeration liner 39*b*, aeration liner 39 will fit snuggly and evenly between the flange ring 21 (not shown) of air disc 20 (not shown) and flange ring 47 (not shown) of silo 45 (not shown).

Figure 11:
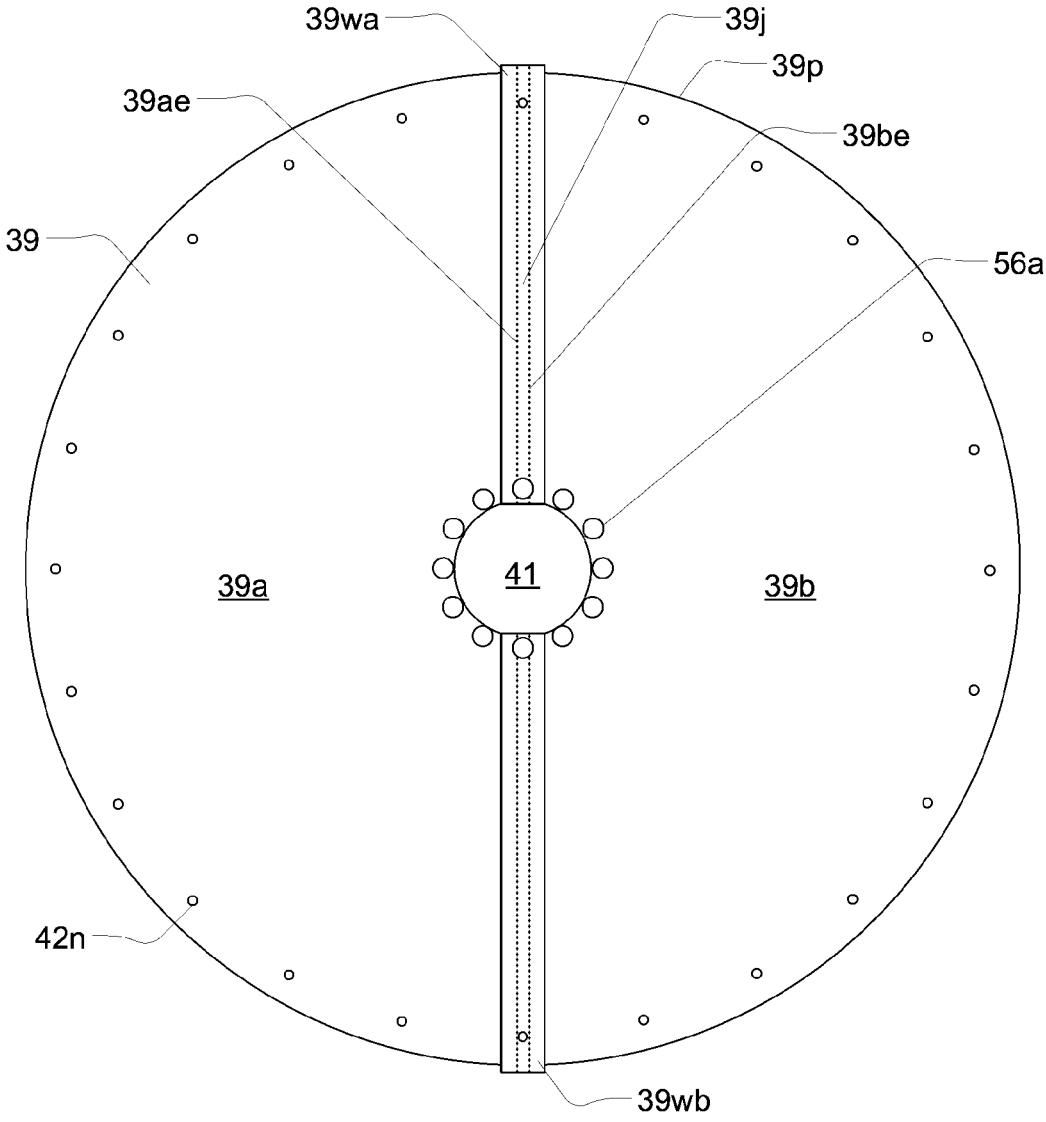
FIG. 11 is a top view of the aeration liner sections joined together by a webbing strip.

FIG. 11 is a top view of aireation liner 39 that would be used in a typical 6' diameter air disc having a slope angle of approximately 15°. Seam edge 39*ae* of left half of aeration liner 39*a* is butted against seam edge 39*be* of right half of aeration liner 39*b* with webbing strips 39*wa* and 39*wb* sewn over seam edges 39*wa* and 39 to form a single aireation liner 39. Aireation Liner 39 can be made in one piece construction for smaller air discs (4 ply polyester belting can be purchased in 48" widths) or in multiple sections for larger air discs and or for air discs having a steeper slope angle, requiring more belting fabric. The preferred method of installing aireation liner 39 to air disc 20 (not shown) is to make the diameter of aireation liner 39 larger than the diameter of the air disc flange 21 (not shown) so that the perimeter 39*p* extends a few inches outward and can be trimmed off at the time of installing air disc 20 to silo 45. Perimeter holes as shown by hole 42*n* and spout holes as shown by 56*a* can actually punched in place by using a hammer and drift pin. The installer simply feels for the holes in the air disc flanges and hammers the drift pin through the belting fabric of the aireation liner. A bead of caulk may be applied to the air disc surfaces under the aireation liner to provide an airtight and leak proof connection.

Figure 12:
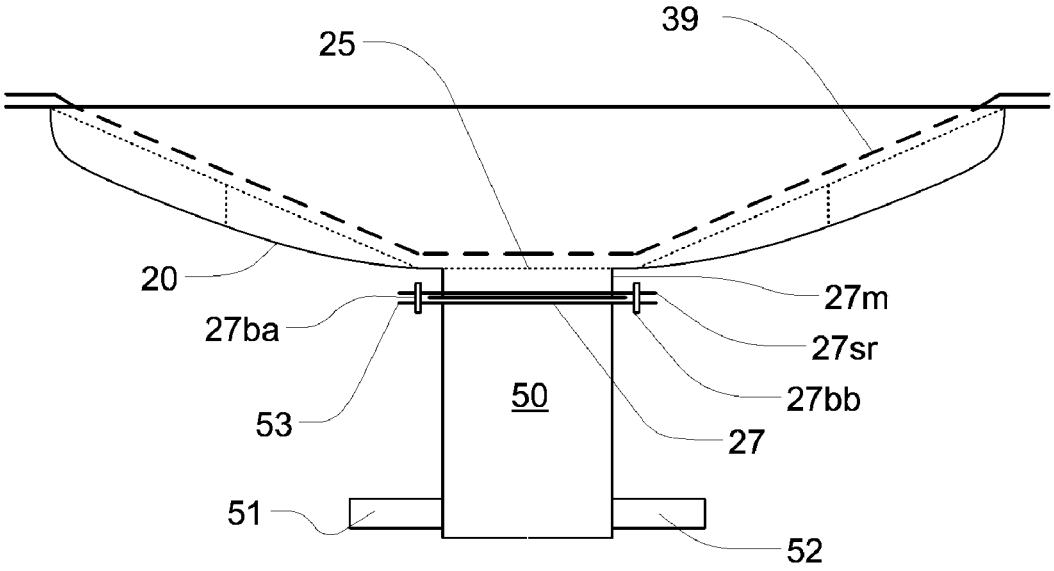
FIG. 12 is a side view of a slip ring mounted on the spout of the air disc flange to connect with the flange of another discharge assembly.

FIG. 12 is a side view of air disc 20 having discharge spout 27*m* with bottom flange ring 27. To make the installation process easier to perform when connecting discharge spout 27*m* to rotary valve assembly 50, slip ring 27*sr* is located above flange ring 27. Slip ring 27*sr* is equipped with holes so that slip ring 27*sr* can be rotated to align with holes of stack-up flange 53 of rotary valve assembly 50. Gasket or caulk material (not shown) may be placed between slip ring 27*sr*, flange ring 27 and stack-up flange 53 to form tight and leak-proof connection. Bolts 27*ba* and 27*bb* can be used to connect and hold slip ring 27*sr* and stack-up flange 53 together.

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. An apparatus for discharging dry bulk material by aeration comprising a substantially annular flexible aeration liner; the aeration liner comprising a semi-circular top panel;

a semi-circular bottom panel; and a webbing strip for joining the top panel and bottom panel; coaxially disposed upon a substantially frustro-conical perforated hopper, which is affixed to an air disc assembly;

whereby air introduced into the air disc assembly is distributed evenly through the perforated hopper that supports the aeration liner that tends to fluidize dry bulk material, thereby allowing the material to discharge.

2. The apparatus of claim 1, wherein said panels are made of four-ply polyester woven fabric and the webbing strip is made of one selected from the group consisting of polyester and nylon.

3. An apparatus for discharging dry bulk material by aeration comprising a substantially annular flexible aeration liner, the aeration liner comprising a roped edge located at a perimeter flange area; coaxially disposed upon a substantially frustro-conical perforated hopper, which is affixed to an air disc assembly;

whereby air introduced into the air disc assembly is distributed evenly through the perforated hopper that supports the aeration liner that tends to fluidize dry bulk material, thereby allowing the material to discharge.

4. The apparatus of claim 3, the aeration liner comprising a plurality of equally spaced scallop cut openings along the perimeter flange area for facilitating removal and replacement of the liner.

5. The apparatus of claim 3, the air disc assembly comprising a dished head;

an access port opening formed into the dished head;

an air stub for attaching a source of air attached to the dished head; and an outlet opening at the center of the dished head.

6. The apparatus of claim 5, further comprising an outlet collar attached to the dished head and surrounding the outlet opening; and an outlet flange attached to the outlet collar.

7. The apparatus of claim 5, further comprising a rotary valve assembly in communication with the outlet opening for controlling the discharge of dry bulk material.

8. The apparatus of claim 7, further comprising an entry tube and an exit tube, each tube being in communication with the rotary valve assembly.

9. The apparatus of claim 3, wherein the air disc assembly is welded to the perforated hopper, thereby forming an air compartment between the air disc dished head and the perforated hopper that diffuses air equally.

10. The apparatus of claim 3, further comprising a silo hopper adapted to be secured to the air disc assembly by bolts on a bolt ring on the perimeter flange such that the aeration liner roped edge is outside the perimeter flange.

11. The apparatus of claim 10, the aeration liner comprising a plurality of equally spaced scallop cut openings along a perimeter flange area matching the bolt locations so that the liner can be removed by loosening the bolts and not removing the bolts.

12. An apparatus for discharging dry bulk material by aeration comprising a substantially annular flexible aeration liner having a roped edge on a liner perimeter flange and a plurality of scallop cut openings along the perimeter flange; the liner coaxially disposed upon a substantially frustro-conical perforated hopper, which is welded to an air disc assembly;

whereby air introduced into the air disc assembly is distributed evenly through the perforated hopper that supports the aeration liner that tends to fluidize dry bulk material, thereby allowing the material to discharge.

* * * * *